US007841452B2

(12) United States Patent
Sansevero et al.

(10) Patent No.: US 7,841,452 B2
(45) Date of Patent: Nov. 30, 2010

(54) CONVEYOR PASSENGER INTERFACE SYSTEM

(75) Inventors: Frank Sansevero, Glastonbury, CT (US); Zuhair S. Bahjat, Farmington, CT (US); Harry Terry, Avon, CT (US); Richard K. Pulling, Avon, CT (US); Daniel James Stillion, Woodside, CA (US); Kate M. Schreiber, Cambridge, MA (US); Gregg Robert Draudt, Stow, MA (US); Jared Alden Judson, Topsfield, MA (US)

(73) Assignee: Otis Elevator Company, Farmington, CT (US)

( * ) Notice: Subject to any disclaimer, the term of this patent is extended or adjusted under 35 U.S.C. 154(b) by 756 days.

(21) Appl. No.: 11/629,139

(22) PCT Filed: Jun. 11, 2004

(86) PCT No.: PCT/US2004/019051

§ 371 (c)(1),
(2), (4) Date: Dec. 7, 2006

(87) PCT Pub. No.: WO2006/001804

PCT Pub. Date: Jan. 5, 2006

(65) Prior Publication Data

US 2007/0158141 A1 Jul. 12, 2007

(51) Int. Cl.
*B66B 1/34* (2006.01)

(52) U.S. Cl. ..... 187/396; 187/382; 187/391

(58) Field of Classification Search ..... 187/247, 187/380–388, 391–396
See application file for complete search history.

(56) References Cited

U.S. PATENT DOCUMENTS

| | | | | | |
|---|---|---|---|---|---|
| 5,255,341 | A * | 10/1993 | Nakajima | 704/200 |
| 5,551,533 | A * | 9/1996 | Ng | 187/391 |
| 5,689,094 | A * | 11/1997 | Friedli et al. | 187/384 |
| 5,952,626 | A * | 9/1999 | Zaharia | 187/381 |
| 6,223,160 | B1 | 4/2001 | Kostka et al. | |
| 6,315,083 | B1 * | 11/2001 | Schuster et al. | 187/391 |
| 6,394,231 | B1 * | 5/2002 | Schuster et al. | 187/382 |
| 6,510,924 | B2 * | 1/2003 | Bauer et al. | 187/380 |
| 6,801,792 | B1 * | 10/2004 | Schuster et al. | 455/566 |
| 6,828,918 | B2 * | 12/2004 | Bowman et al. | 340/825.19 |
| 6,986,408 | B2 * | 1/2006 | Takeuchi | 187/380 |
| 7,021,429 | B2 * | 4/2006 | Hikita | 187/398 |
| 7,040,458 | B2 * | 5/2006 | Forsythe et al. | 187/396 |
| 7,353,915 | B2 * | 4/2008 | Zaharia et al. | 187/388 |
| 2001/0035314 | A1 | 11/2001 | Yoshida et al. | |

FOREIGN PATENT DOCUMENTS

| | | | |
|---|---|---|---|
| JP | 61189066 | A | 8/1986 |
| JP | 4338076 | A | 11/1992 |
| JP | 6075370 | U | 10/1994 |
| JP | 9110356 | A | 4/1997 |

* cited by examiner

*Primary Examiner*—Jonathan Salata
(74) *Attorney, Agent, or Firm*—Bachman & LaPointe, P.C.

(57) ABSTRACT

A conveyor passenger interface system includes a passenger reception area (10) having a mechanism (14) for receiving a voice request from a passenger. In a preferred embodiment of the present invention, the voice request receiving mechanism (14) is a sound dome. The system further includes a device (18) responsive to the voice request for identifying a conveyor for transporting the passenger to a desired location and for identifying the conveyor to the passenger. The system of the present invention has utility in elevator systems as well as other transportation systems.

14 Claims, 2 Drawing Sheets

CONVEYOR PASSENGER INTERFACE SYSTEM

BACKGROUND OF THE INVENTION

The present invention relates to a conveyor passenger interface system for providing information to a passenger as to which conveyor to use to reach a desired location.

Current elevator systems require that an individual push a button to call an elevator. After the elevator has arrived at the floor where the individual is located, its doors open and the individual must then push a second button to indicate a desired location.

One of the deficiencies of the current systems is that the system controller does not know the destination of the passenger until the passenger pushes the second button. As a consequence, the controller does not effectively use its conveyors to convey the system users to their desired destinations in an efficient manner.

SUMMARY OF THE INVENTION

Accordingly, it is an object of the present invention to provide an improved conveyor passenger interface system which can move a passenger to a desired location without the need to push any buttons.

It is a further object of the present invention to provide an improved conveyor passenger interface system which allows better use of a series of conveyors.

The foregoing objects are attained by the conveyor passenger interface system of the present invention.

In accordance with the present invention, a conveyor passenger interface system is provided. The system comprises a passenger reception area having means for receiving a voice request from a passenger, and means responsive to the voice request for identifying a conveyor for transporting the passenger to a desired location and for identifying the conveyor to the passenger.

Other details of the conveyor passenger interface system of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
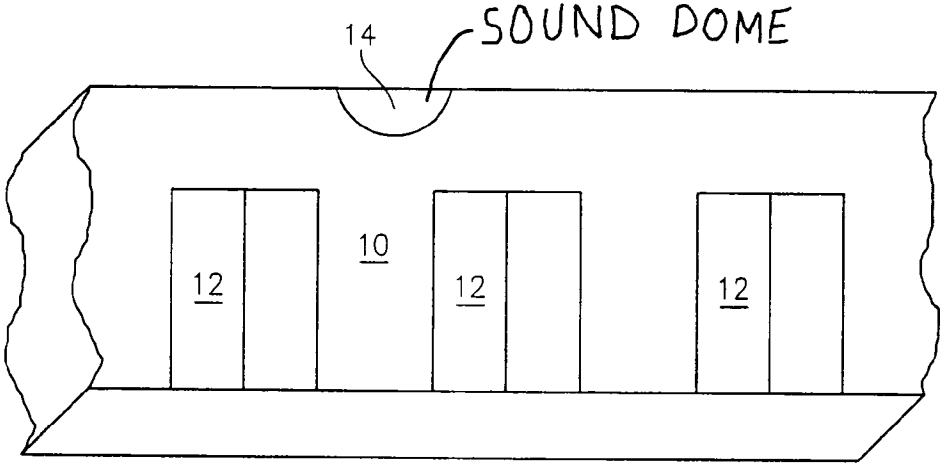
FIG. 1 is a schematic representation of a passenger reception area used in the conveyor passenger interface system of the present invention.

Referring now to the drawings, FIG. 1 illustrates a passenger reception area 10. The reception area 10 may a portion of a lobby on any floor of a building having a plurality of floors. The reception area 10 may be serviced by a plurality of conveyors 12, such as elevator cars. While the conveyors 12 each may service all of the floors of the building, it is contemplated herein that selected ones of the conveyors 12 will serve selected ones of the floors so as to move passengers between the reception area 10 and a desired destination in a very efficient manner.

Figure 2:
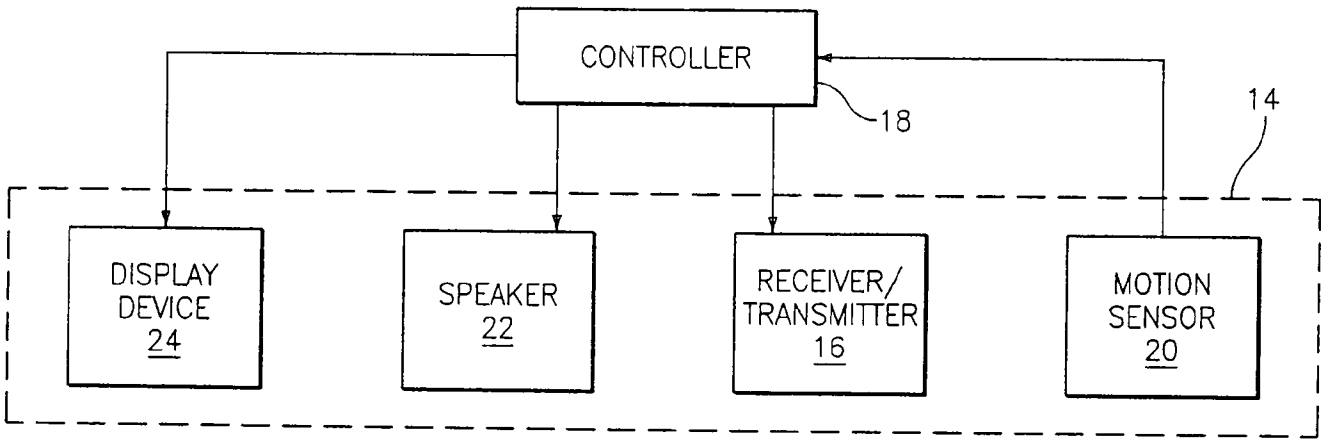
FIG. 2 is a schematic representation of a control scheme for the conveyor passenger interface system of the present invention.

At least one sound dome 14 is preferably provided in the reception area 10. If desired, each reception area 10 may have a plurality of sound domes 14. Each sound dome 14 may be fixed to any static structure in the reception area 10 including, but not limited to, a ceiling, a wall, a post, etc. The sound dome 14, as shown in FIG. 2, may include a receiver/transmitter unit 16. The receiver/transmitter unit 16 may comprise any such unit known in the art. The receiver part of the unit 16 detects an oral command from a passenger and the transmitter part of the unit 16 conveys the oral command to a controller 18. The controller 18 may be any suitable processing unit known in the art and may be programmed with any suitable voice recognition software.

The sound dome 14 may also include a motion sensor 20 for detecting the presence of a passenger. It may also include a speaker 22 through which voice responses can be given. Upon sensing the presence of a passenger via the motion sensor 20, the controller 18 may generate oral instructions for the passenger which are then communicated to the passenger via the speaker 22.

Still further, the sound dome 14 may include a display device 24 which is connected to the controller 18. The display device 24 can be a light generator for generating a color which corresponds to the color of a conveyor 12 to be taken by the passenger. Alternatively, the display device 24 could be a symbol generator which generates a particular symbol or number which correlates with a particular conveyor 12 to be taken by the passenger. The generated color, symbol, or number can be displayed in any desired manner. For example, they could be displayed on the floor or a wall of the reception area. Alternatively, they could be displayed on a panel affixed to a wall of the reception area 10 or to some other static structure, such as a post, in the reception area 10.

Upon sensing a passenger, the controller 18 may issue a voice command for the passenger to speak a desired location. The passenger would then state the desired destination which would be detected by the receiver/transmitter unit 16 and transmitted to the controller 18. The controller 18 then selects the conveyor 12 which will most efficiently move the passenger to the desired destination. A signal is then sent from the controller 18 to the display device 24 for generating a symbol, color, number, any combination of colors/symbols/numbers, or other indicia which identifies to the passenger the conveyor 12 to be taken. For example, if a color is generated, the color will correspond to a color panel affixed adjacent or above a conveyor to be taken. If a number or symbol is generated, the number or symbol make correspond to a number or symbol on the door of the conveyor or on a wall adjacent the conveyor. The communication between the controller 18 and the sound dome 14 can be established in many different ways including but not limited to hard wired connection, wireless, or any other type of communication that will allow the registered message to be communicated from the sound dome 14 to the controller 18 and vice versa.

Figure 3:
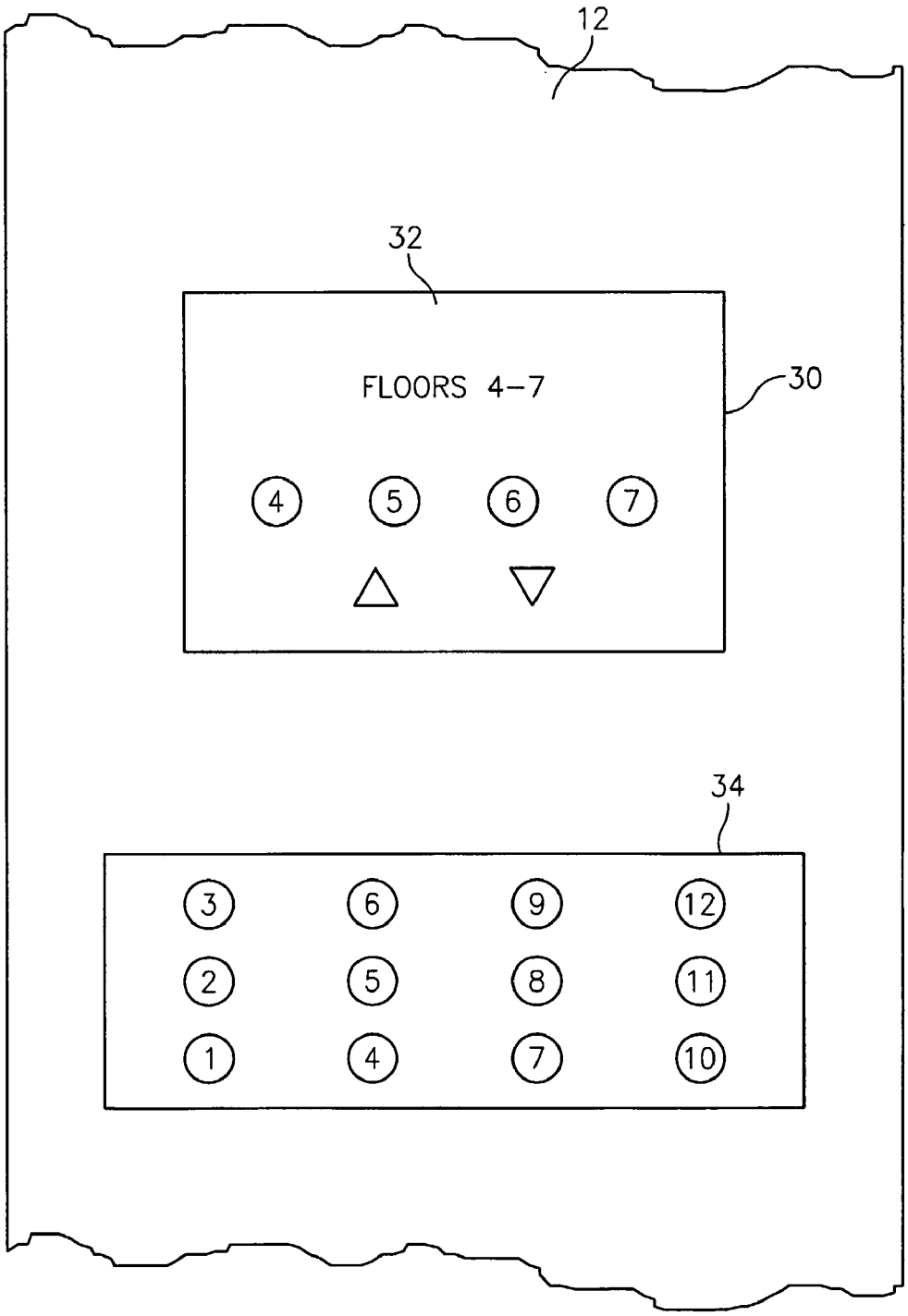
FIG. 3 is a schematic representation of a panel inside the conveyor.

Referring now to FIG. 3, there is a panel 30 inside of each conveyor 12 which has a display 32 which indicates (1) the destinations, e.g. range of floors, serviced by the conveyor, (2) the destination(s) at which the conveyor has been assigned to stop due to the oral command of the passenger(s), and (3) the direction of movement/position of the conveyor. If a passenger getting onboard the conveyor 12 does not see his/her requested destination, the passenger then knows that further action is needed to get the conveyor to stop at the desired destination. This further action may be nothing more than pushing a button on a second panel 34 to the conveyor 12, provided that the conveyor is servicing the destination. If the passenger destination is beyond the conveyor 12 service destination, then he/she either have to exit the conveyor 12, or travel to the nearest floor that conveyor 12 service and exit. One of the advantages to the display 32 is that it allows a passenger to ascertain whether the reason why his desired destination is not indicated is because the conveyor 12 does not service that destination.

During off-peak hours, the sound domes 14 could disappear and the conveyor system could function as a standard system. Thus, if the conveyor system is an elevator system, a passenger may have to push a button to call an elevator car to take him/her to a desired floor.

While the present invention has been described in the context of elevator systems, the conveyor passenger interface system of the present invention has broad utility. For example, the system could be used to move passengers on a tram system or a system involving other transportation vehicles.

It is apparent that there has been provided in accordance with the present invention a conveyor passenger interface system which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations, as fall within the broad scope of the appended claims.

What is claimed is:

1. A conveyor passenger interface system comprising:

a passenger reception area having a plurality of passenger conveyors, said passenger reception area including motion detecting means for detecting the presence of a passenger and means for receiving a voice request from said passenger;

control means for generating oral instructions for said passenger which are communicated to the passenger upon initial detection by said motion detecting means of the passenger's presence;

said control means having means responsive to said voice request for selecting one of said conveyors for transporting said passenger to a desired location; and a display device within said reception area for receiving a signal from said control means and for identifying said one conveyor selected by said control means to said passenger.

2. A conveyor passenger interface system according to claim 1, wherein said responsive means includes a controller and said voice request receiving means comprising a sound dome mounted to a static structure, and wherein said display device is located within said sound dome.

3. A conveyor passenger interface system according to claim 2, wherein said sound dome has a receiver and means for transmitting said voice request to said controller.

4. A conveyor passenger interface system according to claim 1, wherein said display device comprises light means for indicating said selected conveyor to said passenger.

5. A conveyor passenger interface system according to claim 1, wherein said display device further comprises means for aurally indicating said selected conveyor to said passenger.

6. A conveyor passenger interface system according to claim 1, wherein said display device further comprises visual means for indicating said selected conveyor to said passenger.

7. A conveyor passenger interface system according to claim 6, wherein said visual means displays at least one of a color, a symbol, or a letter for said conveyor on a floor of said reception area.

8. A conveyor passenger interface system according to claim 1, further comprising a panel in said conveyor indicating at least one of a plurality of destinations served by said conveyor, a destination requested by said passenger, and a direction of movement of said conveyor.

9. A method of interfacing a passenger with a conveyor comprising the steps of:

providing a reception area having motion detection means for detecting the presence of a passenger and means for receiving an oral command from said passenger;

generating oral instructions from a controller for said passenger and communicating said oral instructions to the passenger upon initial detection of the passenger's presence by said motion detection means;

said passenger stating a desired destination when in the presence of said receiving means;

transmitting said desired destination to said controller;

selecting one of said conveyors to be used by said passenger with said controller; and indicating said selected conveyor to said passenger.

10. A method according to claim 9, wherein each of said conveyors has a color associated therewith and said indicating step comprises generating a color which corresponds to the color associated with said selected conveyor.

11. A method according to claim 9, wherein each of said conveyors has a symbol associated therewith and said indicating step comprises generating a symbol which corresponds to the symbol associated with said selected conveyor.

12. A method according to claim 9, wherein each of said conveyors has a number associated therewith and said indicating step comprises generating a number which corresponds to the number associated with said selected conveyor.

13. A method according to claim 9, further comprising providing voice responses to said passenger.

14. A method according to claim 9, further comprising indicating to said passenger at least one of a range of destinations to be serviced by said conveyor, at least one destination for said conveyor, and a current direction of said conveyor.

* * * * *